US006098254A

United States Patent [19]

Willinger

[11] Patent Number: 6,098,254

[45] Date of Patent: Aug. 8, 2000

[54] GARMENT HANGER CLIP RELEASE GUARD

[75] Inventor: Jonathan Willinger, Tenafly, N.J.

[73] Assignee: Randy Hangers, East Rutherford, N.J.

[21] Appl. No.: 09/115,367

[22] Filed: Jul. 14, 1998

[51] Int. Cl.[7] ..... A47G 25/48

[52] U.S. Cl. ..... 24/501

[58] Field of Search ..... 223/94; 24/500, 24/501, 507, 508, 509–511; D6/326

[56] References Cited

U.S. PATENT DOCUMENTS

| | | |
|---|---|---|
| D. 185,716 | 7/1959 | Nalle, Jr. . |
| D. 212,444 | 10/1968 | Coon . |
| D. 296,729 | 7/1988 | Blanchard . |
| D. 299,086 | 12/1988 | Wilson . |
| D. 316,334 | 4/1991 | Duester . |
| 2,613,857 | 10/1952 | Pechtel . |
| 3,268,128 | 8/1966 | Hobi . |
| 3,456,262 | 7/1969 | Coon . |
| 3,767,092 | 10/1973 | Garrison et al. . |
| 3,946,915 | 3/1976 | Crane . |
| 4,054,234 | 10/1977 | Thomas . |
| 4,194,274 | 3/1980 | Garrison . |
| 5,052,600 | 10/1991 | Elchisak et al. . |
| 5,183,191 | 2/1993 | Garrison et al. . |
| 5,267,678 | 12/1993 | Zuckerman . |
| 5,400,932 | 3/1995 | Hollis . |
| 5,516,014 | 5/1996 | Garrison . |
| 6,021,933 | 2/2000 | Zuckerman . |

FOREIGN PATENT DOCUMENTS

| | | |
|---|---|---|
| WO 90/13248 | 11/1990 | WIPO . |

*Primary Examiner*—James R. Brittain
*Attorney, Agent, or Firm*—Helgott & Karas, P.C.

[57] ABSTRACT

A garment hanger clip is provided with a pair of clip jaws having lateral projecting portions or extensions which prevent or reduce unintended release of the clip jaws when a series of hangers is pressed or pushed together. The projections or release guards are advantageously located beneath the pivot point of the clip jaws so that lateral or sideward force applied to the guards tends to close the jaws even tighter.

12 Claims, 8 Drawing Sheets

GARMENT HANGER CLIP RELEASE GUARD

BACKGROUND OF THE INVENTION

1. Field of the Invention

The present invention relates in general to spring clips for clamping garments to clothes hangers, and relates in particular to such clips provided with bumper guards for preventing accidental or unintended release of garments from the clips.

2. Description of Prior Developments

Garment hangers are available in numerous configurations for the general purpose of releasably clamping a garment to a hooked hanger so as to allow the garment to be suspended from a closet hanger rod, a retail clothes rack, a shipping rack, or any other support. One such hanger is disclosed by Braitrim in European Pat. 8909821.4. This hanger, known variously as a bottom hanger, shirt hanger or pant hanger includes a conventional hanger bar and two clips.

The Braitrim clip clamps closed by the action of a resilient metal or plastic spring piece which pushes apart the top of the clip jaws and applies clamping pressure to the bottom of the clip jaws.

This type of hanger has several advantages as well as drawbacks. An advantage is that the pressure on the garment is very significant and therefore retailers experience less problems with garments unintentionally dropping off the hangers. Consumers find the clip easier to manipulate than the "grip-it" style hanger as disclosed by Batts in U.S. Pat. Nos. 3,698,607 and 3,767,092.

A major inconvenience associated with the type of clips disclosed in the Braitrim and Batts patents is that when clipped garments are shipped or otherwise arranged in tight side-by-side contact with one another, the tops of the clips abut one another thereby pushing the jaws of the clips open, releasing the garments and dropping them on the floor. A need therefore exists to prevent hanger clips from opening due to inadvertent lateral pressure from garments hanging next to each other during shipment and otherwise.

SUMMARY OF THE INVENTION

The present invention has been developed to fulfill the needs noted above and therefore has as an object the provision of a release guard for a clip of the type used with a garment hanger.

Another object of the invention is to modify an existing hanger clip structure with a simple, inexpensive enhancement which prevents unintended release of a garment from the jaws of the clip.

Another object is to provide a conventional garment hanger clip with lateral projections or bumpers which limit or prevent contact between the top or release lever portions of the clip as the hangers and attached garments are compressed together on a rack during storage, retail display or shipping.

These and other objects are met by the present invention which is directed to a clip adapted for use with a garment hanger. The clip is provided with lateral extensions, guards or bumpers which limit or prevent engagement between the release or top level portion of each clip when several clips are pressed against one another as occurs during shipment of a group of garments hung on and compressed against one another on a shipping rack.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings

In the various figures of the drawings, like reference characters designate like parts.

DETAILED DESCRIPTION OF THE PREFERRED EMBODIMENTS

The present invention will now be described in conjunction with the drawings, beginning with FIG. 1 which shows a conventional hanger 10 of the type used to hang clothes on a hanger rack or the like. Hanger 20 includes a hanger bar 12 having a hook 14 centrally connected to the bar 12 by a support 16.

Figure 2:
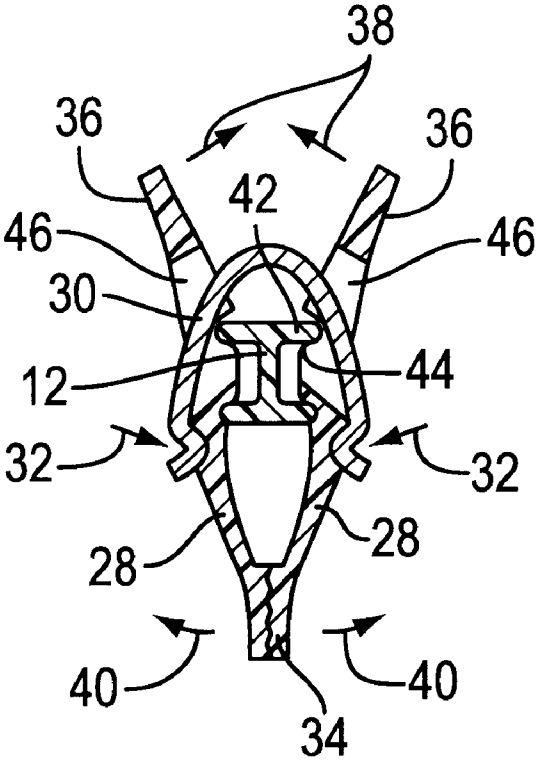
FIG. 2 (PRIOR ART)
FIG. 2 is a view in section taken through line 2—2 of FIG. 1.

Bar 12 includes an upper rib 18 and a lower rib 20. Hooks 22 may be formed on the ends of bar 12 to provide additional support for a garment. As seen in FIG. 2, bar 12 has a somewhat I-shaped cross section.

A pair of garment clips 24 is slidably mounted on bar 12 for gripping and suspending a garment from the hanger 10. Each clip 24 includes a pair of clip jaws 28 which symmetrically straddle the bar 12. A generally U-shaped spring clip 30 biases the bottom portions of the clip jaws against one another in the direction of arrows 32 in FIG. 12 so that the jaw teeth 34 on the jaws normally interengage each other.

When it is desired to open the clip jaws 28 to insert or release a garment, the clip release levers 36 are pinched together in the direction of arrows 38. This causes the jaw teeth 34 to pivot and swing open in the direction of arrows 40.

A pivot connection is formed between the outer edges 42 of the upper rib 18 and a recess 44 formed on inner surface of each clip jaw 28. Clearance holes or apertures 46 are formed in each clip jaw 28 to allow the spring clips to pass therethrough.

Figure 1:
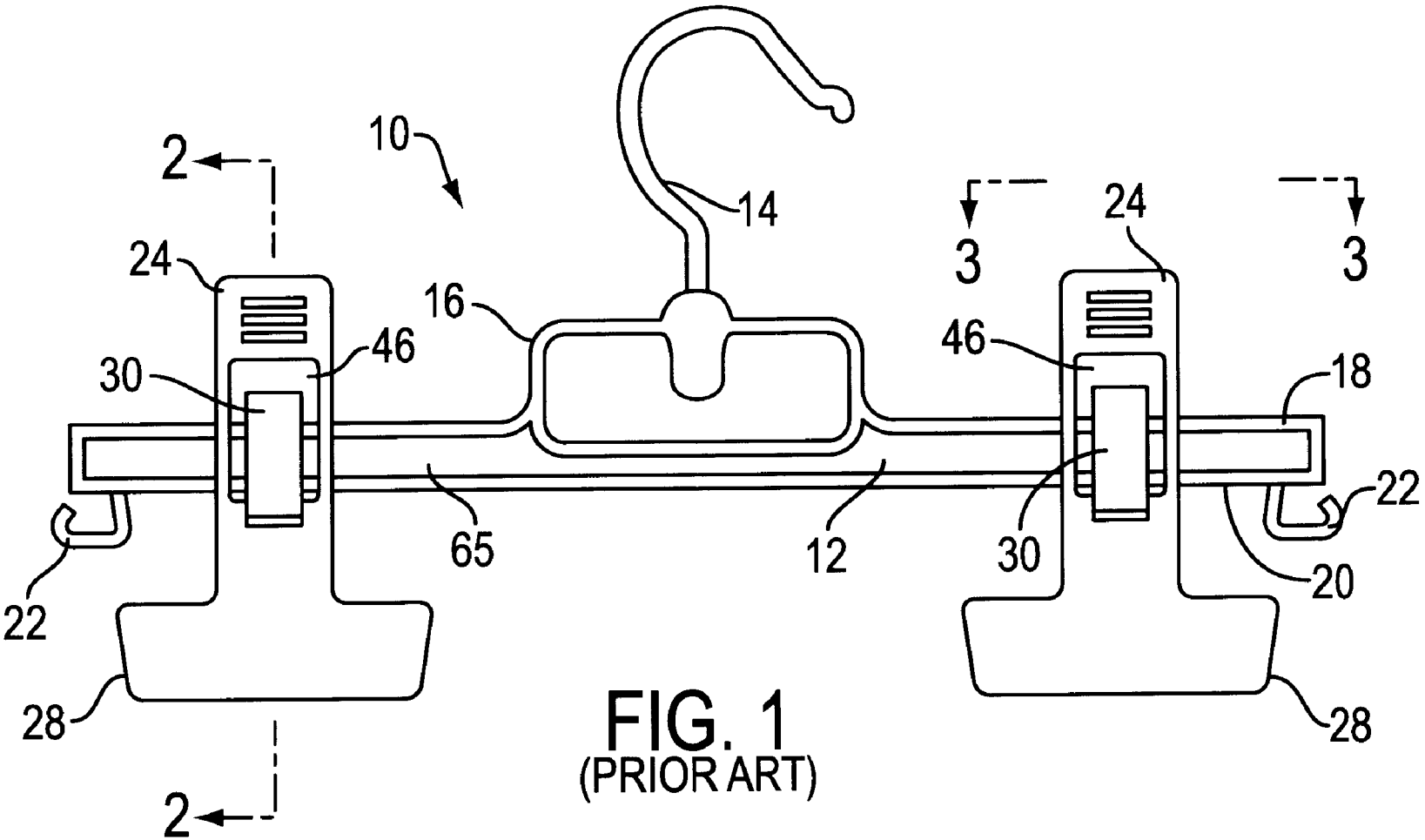
FIG. 1 (PRIOR ART)
FIG. 1 is a front elevation view of a first type of conventional garment hanger.

Although the garment clips 24 of FIG. 1 generally function adequately, a problem arises when several of the hangers 10 are suspended from a support, as is common during the shipment of an order of garments. In this case, the garments and hangers 10 are often squeezed or pressed together one against another, as represented by the force arrows 48 in FIG. 4.

Figure 4:
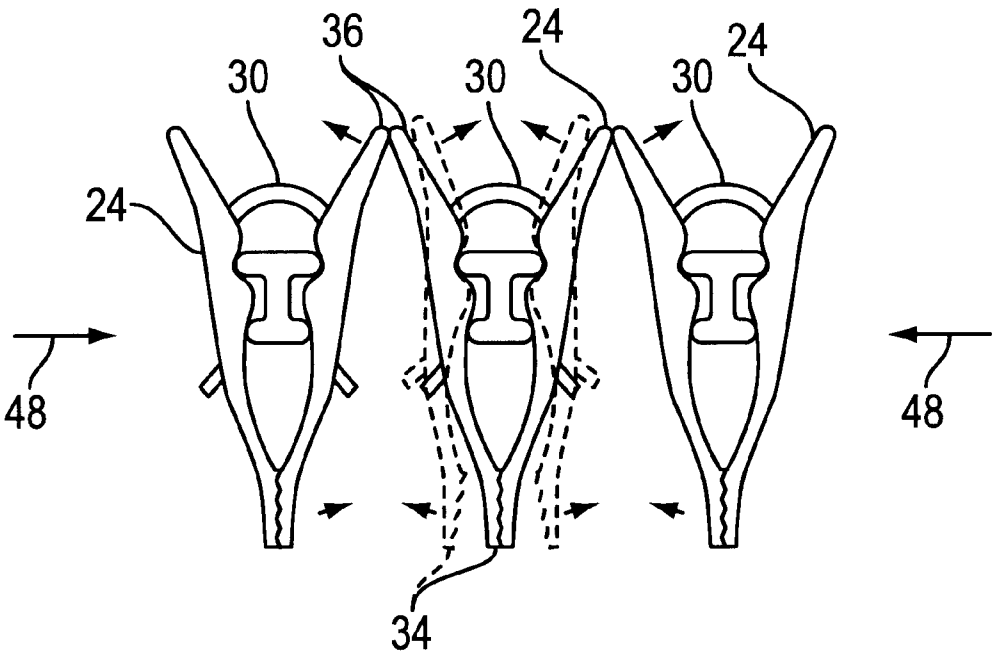
FIG. 4 is an end view of a series of hangers of the type shown in FIG. 1.

This force 48 causes the clip release levers 36 to engage and abut one another and thereby open one or more pair of jaw teeth 34, as shown in dashed lines in FIG. 4. This action is further represented by the small directional arrows in FIG. 4. In the case where a garment is held between the jaw teeth 34, the result of such abutment can be the release of the garment onto the floor where it can be wrinkled, soiled, torn or otherwise damaged.

Figure 5:
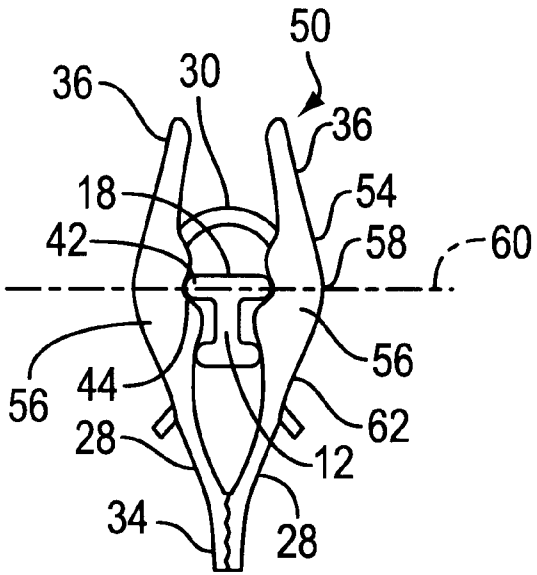
FIG. 5 is an end view of a hanger clip constructed in accordance with a first embodiment of the invention.
Figure 6:
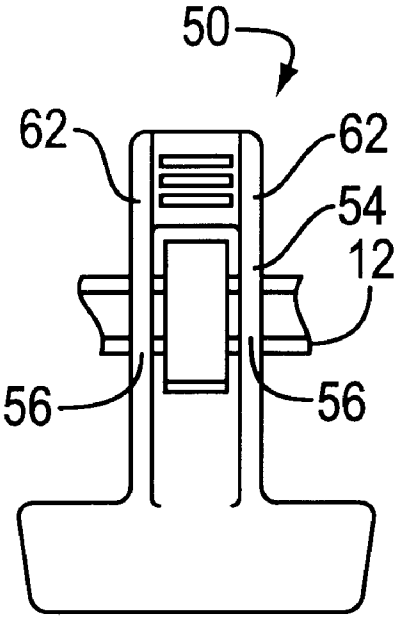
FIG. 6 is a front view of the clip of FIG. 5.

In order to prevent such undesired release of a garment, the garment clip 50 of FIGS. 5 and 6 has been developed in accordance with the invention. Clip 50 is of the same construction as clip 24 discussed above, except for the shape and orientation of the release levers 36. In this embodiment, the release levers 36 taper or converge toward one another as they project away from bar 12, rather than diverge from one another as in the prior example.

An import ant feature of the invention is the formation of a bumper or release guard portion 54 on Each clip jaw 28, each guard portion 54 advantageously is formed with a lateral or transverse projection 56 having an outermost extremity or apex 58 disposed on or below the plane 60 extending through the pivot points of pivot connections 42, 44.

With this relationship between the apex 58 and pivot connections 42, 44, abutment between adjacent clips 50 will not tend to open the clip jaws 28. In fact, when the pivot point of the clip jaws is above apex 58, abutment of adjacent clips 50 at the apices 58 will actually apply a greater clamping force to jaw teeth 34 rather than an opening force.

As seen in FIG. 6, the transverse projections 56 may be formed as a pair of vertically extending ribs 62 which define a somewhat bowed or arcuate end profile as seen in FIG. 5. A significant feature of the invention is thus the provision of lateral bumpers, abutments or extensions on each side of the clip 24 which are arranged to make first contact with a corresponding portion of an adjacent clip when a series of hangers is compressed so that the hangers are forced against one another.

It can be appreciated that many different arrangements can be envisioned for the structure of the clip release guards 54. For example, in FIGS. 7 and 8, a clip 50 virtually identical to clip 24 of FIG. 2 is modified to include a pair of laterally projecting U-shaped ribs 64 which serve as a pair of guards 54. The extremity or apex 58 of each rib 64 preferably extends transversely outwardly from the longitudinal axis 65 (FIG. 1) of bar 12 about as far as or further than the top 66 of each release lever 36. This ensures that contact between the release levers 36 is prevented or substantially reduced.

Figure 9:
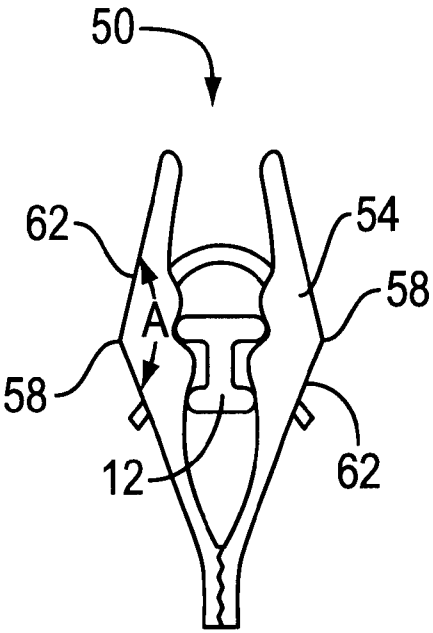
FIG. 9 is an end view of another embodiment of the invention.
Figure 13:
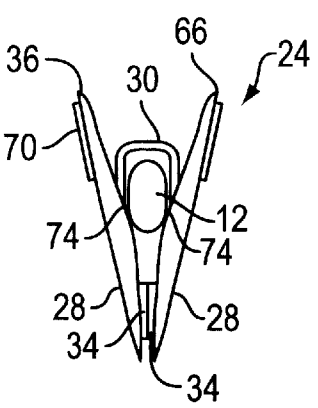
FIG. 13 (PRIOR ART)
FIG. 13 is an end view of the hanger and clip of FIG. 12 taken from line 13—13 of FIG. 12.

The clip 50 of FIG. 9 is a variation of that of FIG. 5, wherein the bowed or arcuate side profile of ribs 62 is modified in a form similar to a triangle having an obtuse angle A centered at apex 58 which defines the vertex of angle A.

Figure 8:
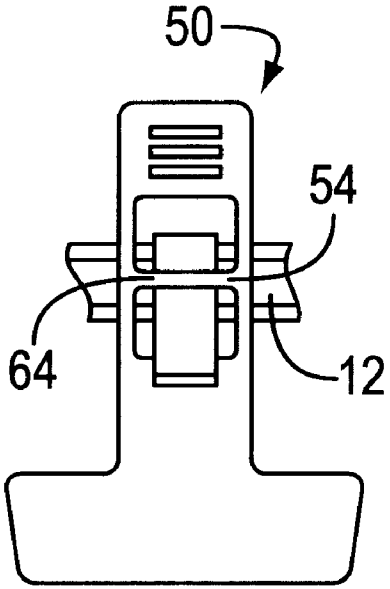
FIG. 8 is a front view of the clip of FIG. 7.
Figure 7:
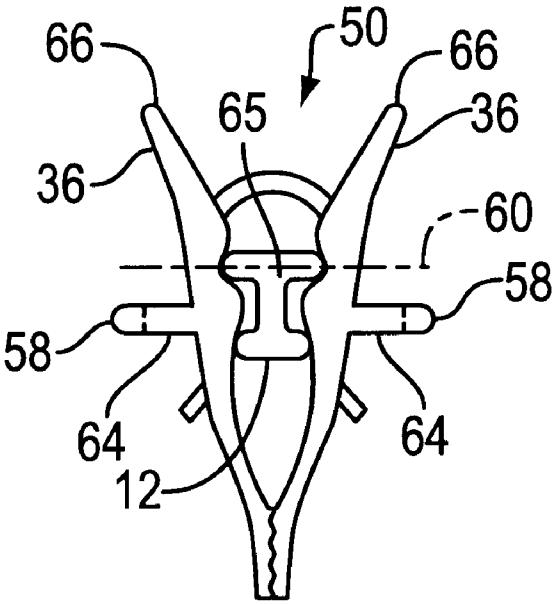
FIG. 7 is and end view of another embodiment of a hanger clip according to the invention.
Figure 11:
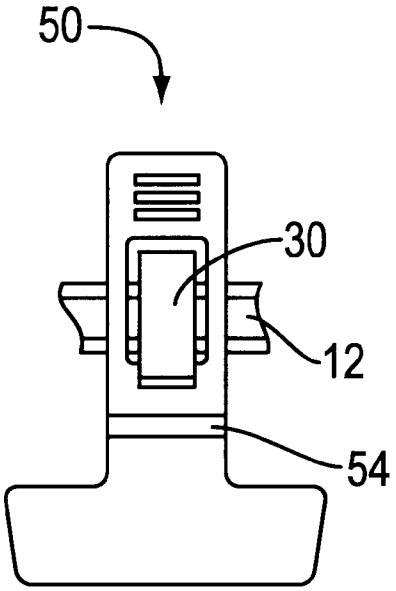
FIG. 11 is a front view of FIG. 10.
Figure 10:
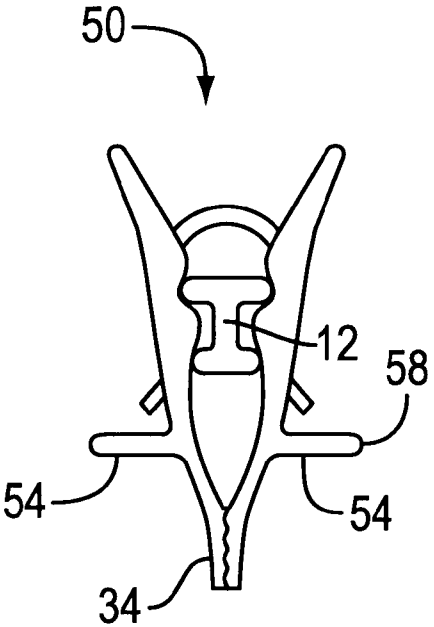
FIG. 10 is an end view of another embodiment of the invention.

The clip 50 of FIGS. 10 and 11 is substantially the same as the clip 50 of FIGS. 7 and 8 except that the release guard 54 of FIGS. 10 and 11 is located below bar 12, just above and adjacent to the jaw teeth 34. Guard 54 may be solid, planar and generally rectangular in plan view.

Another type of conventional hanger 10 is shown in FIG. 12, 13, 14 and 15. This hanger is constructed in accordance with European patent 8909821.4 and operates in the same general fashion as the hanger 10 of FIGS. 1, 2 and 3. Clip 24 of FIG. 12 includes a pair of rectangular clamp plates or clip jaws 28 biased together by spring 30 in the same manner as jaws 28 of FIG. 2. Circular ridged grips 70 facilitate pinching and release operation of the clip.

Figure 12:
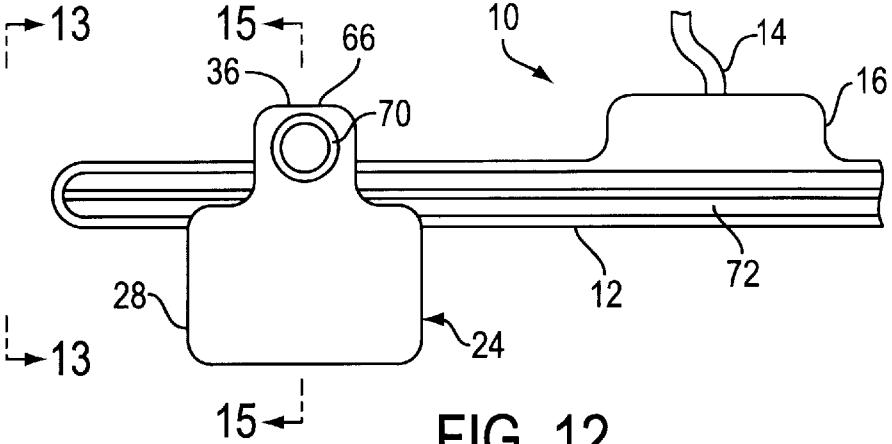
FIG. 12 (PRIOR ART)
FIG. 12 is a partial front elevation view of a second type of conventional garment hanger.
Figure 15:
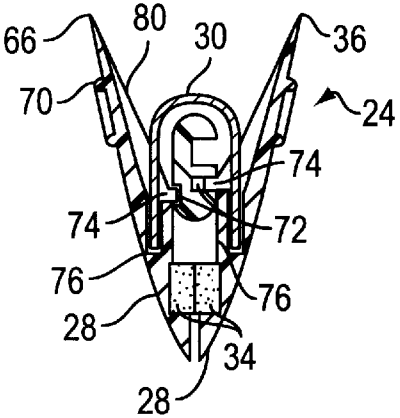
FIG. 15 (PRIOR ART)
FIG. 15 is a view in section taken along line 15—15 of FIG. 12.
Figure 14:
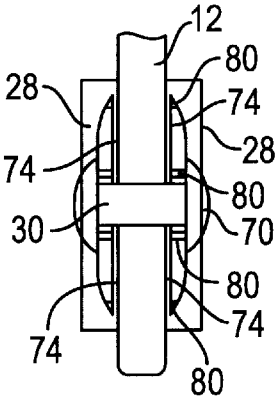
FIG. 14 (PRIOR ART)
FIG. 14 is a partial top plan view of the hanger and clip of FIG. 12.

As seen in FIGS. 12 and 15, clip 24 includes a pair of foam or elastic teeth 34 for gripping a garment. As further seen in FIGS. 12 and 15, bar 12 is formed with opposed grooves 72 within which slide the longitudinally-extending rails 74 formed on each clip jaw 28. Spring 30 is held in internal pockets 76 formed in the inner surface of each clip jaw 28. Strengthening ribs 80 (FIG. 14) are also formed on the inner surface of each clip jaw 28.

Figure 3:
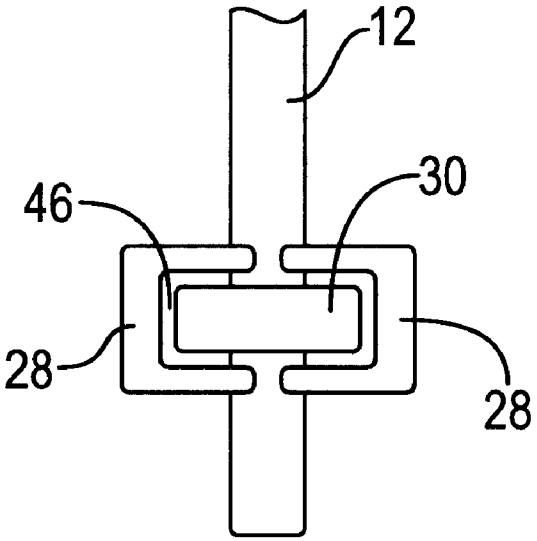
FIG. 3 (PRIOR ART)
FIG. 3 is a top plan view taken from line 3—3 of FIG. 1.

It can be appreciated that clips 24 of FIGS. 12–15 are subject to the same drawback of undesired garment release as that of the clips 24 of FIGS. 1–3. That is, abutment between a pair of release levers 36 causes the jaw teeth 34 to open and release a garment.

Although each of the release guards 54 of FIGS. 4–11 can be readily adapted and used effectively with the clip 24 of FIGS. 12–15, the clip release guards and clip release lever arrangements of FIGS. 16–24 are particularly effective in preventing undesired garment release from the clip 24 of FIGS. 12–15. Moreover, the clip release guards and clip release lever arrangements of FIGS. 16–24 can also be effectively adapted and used with the clips 24 of FIGS. 1–3.

Figure 16:
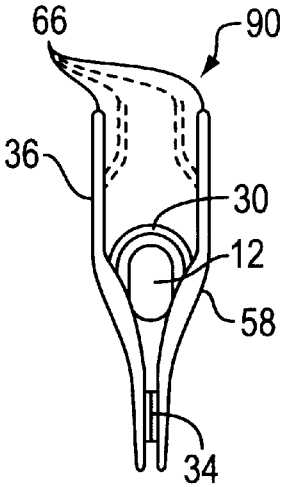
FIG. 16 is an end view of another embodiment of the invention.
Figure 17:
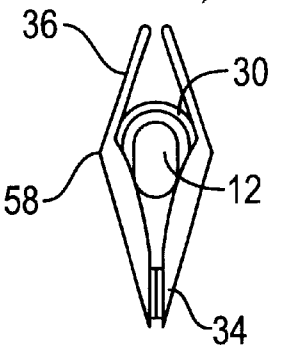
FIG. 17 is an end view of another embodiment of the invention.
Figure 18:
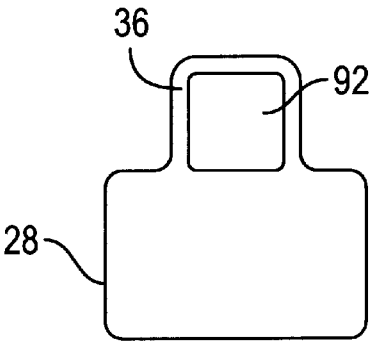
FIG. 18 is a front view of a clip jaw modified in accordance with the invention.
Figure 19:
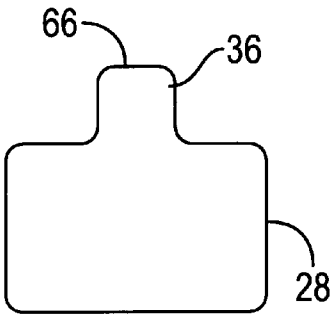
FIG. 19 is a front view of another clip jaw modified in accordance with the invention.
Figure 20:
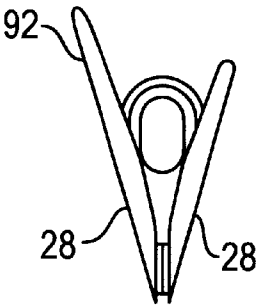
FIG. 20 is an end view of another embodiment of the invention constructed with the clip jaws of FIGS. 18 and 19.

As seen in FIG. 16, clip 90 is modified in accordance with the invention such that the outer sides of the clip release levers 36 are arranged vertically and parallel with one another. The tips 66 may extend toward one another as shown in dashed lines. In FIG. 17, the release levers 36 converge toward one another as they extend away from rod 12, similar to the embodiment of FIG. 9.

Figure 21:
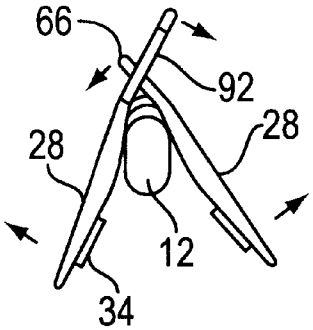
FIG. 21 is a view of the clip of FIG. 20 with the clip jaws opened.

The clip jaws 28 of FIG. 12 are further modified as shown in FIGS. 18 through 22 to allow for a greater extent of release motion of the release levers 36 and jaw teeth 34. In FIGS. 18–21, one of the release levers 36 is formed longer than the other. The longer lever 36 is formed with a through-passage or aperture 92 to allow the tip 66 of the other coacting lever 36 to pass therethrough as shown in FIG. 21.

Figure 22:
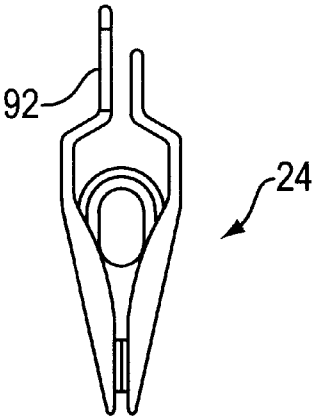
FIG. 22 is a view of another embodiment of the invention.

This variation is particularly useful in those cases where the release levers 36 are close to one another in their normally closed configuration, such as in FIGS. 17 and 22. In these cases, the jaw teeth or pads 34 can be separated a greater distance to receive or release a garment than if no aperture 92 were provided.

Figure 24:
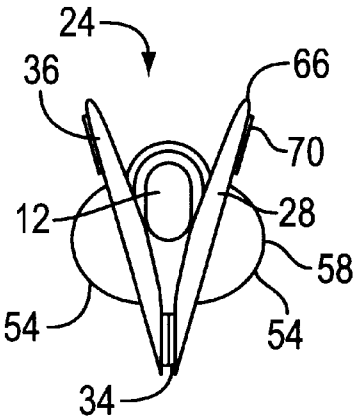
FIG. 24 is an end view of a hanger clip and hanger constructed with a pair of the jaws of FIG. 23.
Figure 23:
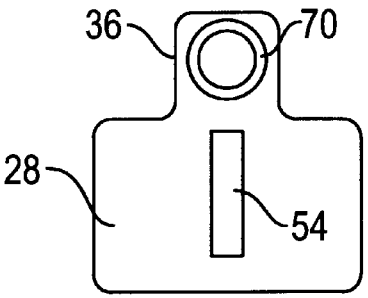
FIG. 23 is a front elevation view of a clip jaw constructed in accordance with another embodiment of the invention.

Another embodiment of the invention is shown in FIGS. 23 and 24 wherein clip release guards 54 are formed as arcuate, somewhat semi-circular lateral extensions on the outer surface of each clip jaw 28. This guard configuration can be used with either of the hangers 10 of FIGS. 1 and 12. In each case, the apex 58 of each guard 54 extends laterally, i.e. horizontally from bar 12, to a distance about equal to or greater than the horizontal distance of tip 66 from bar 12.

There has been disclosed heretofore the best embodiment of the invention presently contemplated. However, it is to be understood that the various changes and modifications may be made thereto without departing from the spirit of the invention.

What is claimed is:

1. A clip for attachment at a location to a garment hanger, comprising:

a pair of spring-biased clip jaws having a pivot point proximate with the location of attachment of said clip with said garment hanger, said clip jaws being located at one end of said clip along the longitudinal axis of said clip;

a release lever on each of said clip jaws located at the opposite end along the longitudinal axis of said clip; and a projection extending laterally from each of said clip jaws for limiting abutment of said release levers with another clip on another garment hanger, said projection positioned at a location along said longitudinal axis of said clip between said clip jaws and said pivot point so that lateral or sideward force applied to said projections tends to close said clip jaws even tighter.

2. A clip in accordance with claim 1, wherein said projection is in the shape of a U-shaped rib.

3. A clip in accordance with claim 1, wherein said clip jaws further comprise jaw teeth and said projection is positioned adjacent said jaw teeth.

4. A clip for a garment hanger, comprising:

a pair of spring-biased clip jaws comprising release levers on one end and gripping portions on the other end, said clip jaws adapted for pivotal attachment about a pivot location on said garment hanger and biasable between a closed position, where said gripping portions are adapted to grip an object, and an opened position where said gripping portions are adapted to release said object;

wherein said release levers converge toward each other while said clip jaws are in the closed position.

5. A clip in accordance with claim 4, wherein said clip jaws further comprise projections having outermost extremities that extend laterally outward from said clip jaws for limiting abutment of said release levers with another clip on another garment hanger.

6. A clip in accordance with claim 5, wherein said outermost extremities are disposed on or below a plane extending through said pivot location.

7. A clip in accordance with claim 5, wherein said release levers extend along a first plane and said gripping portions extend along a second plane and said outermost extremities define an obtuse angle between said first and second planes of said release levers and said gripping portions respectively.

8. A clip in accordance with claim 5, wherein said clip jaws have a triangular profile.

9. A clip in accordance with claim 5, wherein said projections have an arcuate profile.

10. A clip in accordance with claim 6, wherein said projections are semi-circular.

11. A clip in accordance with claim 6, wherein said outermost extremities and said release levers are aligned along a vertical plane.

12. A clip for a garment hanger, comprising:

a pair of spring-biased clip jaws comprising release levers on one end and gripping portions on the other end, said clip jaws adapted for pivotal attachment about a pivot location on said garment hanger and biasable between a closed position, where said gripping portions are adapted to grip an object, and an opened position where said gripping portions are adapted to release said object; and wherein said clip jaws are provided with laterally extending projections positioned below said pivot location so that a lateral or sideward force applied to said projections tends to maintain said clip jaws in the closed position.

* * * * *